US009786485B2

(12) United States Patent
Ding et al.

(10) Patent No.: US 9,786,485 B2
(45) Date of Patent: Oct. 10, 2017

(54) MASS ANALYSER

(71) Applicant: SHIMADZU CORPORATION, Kyoto-shi (JP)

(72) Inventors: Li Ding, Sale (GB); Aleksandr Rusinov, Altrincham (GB)

(73) Assignee: SHIMADZU CORPORATION, Kyoto-shi, Kyoto (JP)

( * ) Notice: Subject to any disclaimer, the term of this patent is extended or adjusted under 35 U.S.C. 154(b) by 0 days.

(21) Appl. No.: 15/310,990

(22) PCT Filed: Apr. 29, 2015

(86) PCT No.: PCT/IB2015/000609

§ 371 (c)(1),
(2) Date: Nov. 14, 2016

(87) PCT Pub. No.: WO2015/173616

PCT Pub. Date: Nov. 19, 2015

(65) Prior Publication Data

US 2017/0084445 A1 Mar. 23, 2017

(30) Foreign Application Priority Data

May 12, 2014 (GB) ..... 1408392.7

(51) Int. Cl.

*H01J 49/28* (2006.01)
*H01J 49/40* (2006.01)
*H01J 49/06* (2006.01)

(52) U.S. Cl.

CPC ..... *H01J 49/401* (2013.01); *H01J 49/065* (2013.01); *H01J 49/067* (2013.01); *H01J 49/068* (2013.01); *H01J 49/282* (2013.01); *H01J 49/406* (2013.01)

(58) Field of Classification Search

USPC ..... 250/281–283, 286–288, 290, 292, 396 R
See application file for complete search history.

(56) References Cited

U.S. PATENT DOCUMENTS 3,342,993 A * 9/1967 Ferguson ..... H01J 49/067 250/293
3,621,242 A * 11/1971 Ferguson ..... H01J 49/405 250/287

(Continued)

FOREIGN PATENT DOCUMENTS

DE 37 26 952 A1 2/1989

OTHER PUBLICATIONS

Written Opinion of the International Searching Authority of PCT/IB2015/000609 dated Sep. 11, 2015.

(Continued)

*Primary Examiner* — Bernard Souw
(74) *Attorney, Agent, or Firm* — Sughrue Mion, PLLC

(57) ABSTRACT

A mass analyser comprises a pair of electrode arrays. Each array has a set of focusing electrodes which are supplied, in use, with voltage to create an electrostatic field in a space between the electrode arrays causing ions to undergo periodic, oscillatory motion in the space, ions passing between electrodes of the sets of focusing electrodes and being repeatedly focused at a center plane, mid-way between the electrode arrays. At least one electrode of each set of focusing electrodes has an electrode surface closer to the center plane than the electrode surfaces of other electrodes of the same set. The analyzer may be an ion trap mass analyser or a multi-turn ToF mass analyzer.

35 Claims, 6 Drawing Sheets

(56) References Cited

U.S. PATENT DOCUMENTS 4,072,862 A * 2/1978 Mamyrin ..... H01J 49/405 250/286
4,731,532 A * 3/1988 Frey ..... H01J 49/405 250/286
5,017,780 A * 5/1991 Kutscher ..... H01J 49/405 250/287
5,880,416 A * 3/1999 Colby ..... B66B 1/30 187/293
5,886,346 A * 3/1999 Makarov ..... H01J 49/425 250/290
5,942,758 A 8/1999 Park
6,013,913 A * 1/2000 Hanson ..... H01J 49/406 250/282
6,300,625 B1 * 10/2001 Ishihara ..... H01J 49/408 250/287
6,744,042 B2 * 6/2004 Zajfman ..... H01J 3/40 250/281
9,159,544 B2 * 10/2015 Ding ..... H01J 49/027
2007/0029473 A1 * 2/2007 Verentchikov ..... H01J 49/406 250/281
2007/0176090 A1 * 8/2007 Verentchikov ..... H01J 49/406 250/287
2011/0186729 A1 * 8/2011 Verentchikov ..... H01J 49/406 250/282
2013/0068942 A1 * 3/2013 Verenchikov ..... H01J 49/4245 250/282
2014/0217275 A1 * 8/2014 Ding ..... H01J 49/027 250/282
2016/0104609 A1 * 4/2016 Ding ..... H01J 49/027 250/294

OTHER PUBLICATIONS

International Search Report of PCT/IB2015/000609 dated Sep. 11, 2015.

* cited by examiner

MASS ANALYSER

CROSS REFERENCE TO RELATED APPLICATIONS

This application is a National Stage of Application No. PCT/IB2015/000609 filed Apr. 29, 2015, claiming priority based on British Patent Application No. 1408392.7 filed May 12, 2014, the contents of all of which are incorporated herein by reference in their entirety.

This invention relates to a mass analyzer, particularly a mass analyzer utilising an multi-turn ToF or ion trap.

BACKGROUND OF THE INVENTION

One of the important ways to increase mass resolving power and mass accuracy in mass analysis is to design a mass analyzer in which ions are measured during, or after, a long flight path. This kind of mass analyzer has recently been realized in two forms, the multi-turn ToF analyzer and the electrostatic or magnetic field ion trap analyser. In the multi-turn ToF analyzer, a reflecting field is generated by mirror electrodes so that a long, but folded flight path is achieved. A detector including a secondary electron multiplier is used, where, following the folded, long flight, ions splash onto the dynode of the detector and disappear, while an electric current signal is generated to give a ToF mass spectrum. In the electrostatic or magnetic field ion trap configuration, an ion's oscillatory motion induces image current in a pick-up electrode. The induced image current is continually recorded as the ion continually oscillates in the trapping field. The image current signal, after being amplified by a low noise amplifier, is converted to a frequency spectrum using Fourier transform and the frequency spectrum is then directly related to a mass spectrum of the trapped ions.

An early example of a high resolving power mass spectrometer is the so called FTICR, first disclosed in M. B. Comisarow and A. G. Marshall, Chem. Phys. Lett. 25, 282 (1974), where a superconducting coil is used to generate a high intensity, uniform magnetic field to trap ions. Because the coil is large and needs to be cooled to a very low temperature, this instrument is very expensive to build and difficult to run and maintain.

An electrostatic ion trap mass analyser is more attractive because it avoids use of a high strength, high stability superconducting magnet. The Orbitrap, disclosed in Anal. Chem., 2000, 72 (6), pp 1156-1162. by Alexander Makarov, is one example of electrostatic ion trap mass analysers where ions oscillate back and forth in the axial direction while, at the same time, rotating around a central, spindle-shaped electrode. To keep the axial oscillations harmonic, the central and outer electrodes of the Orbitrap need to be very accurately machined so as to achieve a so-called hyper-logarithmic potential inside the trap volume.

It is not necessary for the electrostatic ion trap mass analyser to have a field structure that allows ions to perform harmonic motion in a particular axial direction, such as in the Orbitrap. PCT Publication No WO 2012/116765 Li Ding et al. describes an electrostatic ion trap mass analyser including a first array of electrodes and second array of electrodes to create an electrostatic electric field in the space between the arrays. When both arrays are supplied with the same pattern of voltage, the resultant electric field causes ions to undergo periodic, oscillatory motion in the space between the electrode arrays, ions being repeatedly reflected isochronously in a flight direction and focused substantially at a centre plane, midway between said first and second arrays. An amplifier circuit is used to detect image current related to the mass-to-charge ratio of ions undergoing the periodic, oscillatory motion in the space between the first and second arrays of electrodes. A structure having multiple electrodes is advantageous because it is easier to tune by application of suitable voltages after the analyser has been manufactured. One of the disclosed embodiments (FIG. 9) in WO2012/116765 has a circular configuration, where the field-defining electrodes of each array include a circular, central electrode as well as a plurality of concentric, flat-surfaced ring electrodes, located radially outwards of the central electrode. The two arrays are arranged co-axially on the central axis of the analyser and ions are trapped close to the centre plane which is equidistant to the electrodes in the first and second arrays.

In the development of high resolving power ToF mass analyzers, many configurations of multi-turn ToF system have been designed. In US Publication No US 2010/0044558 A1, Sudakov disclosed a multiple-reflection time-of-flight device constructed using a pair of rectangularly-shaped planar electrode arrays. Ions are reflected in a flight direction (x) by two ion mirrors formed by parallel electrode strips of the planar arrays, and in a drift direction (z) by another reflection field formed by another set of electrode strips of the same planar arrays. Isochronous motion of ions of the same mass-to-charge ratio is achieved during each cycle in the (x-axis) flight direction, and for one reflection in the (z-axis) drift direction.

In U.S. Pat. No. 7,919,748 B2 by Curt Flory et al., another multiple-reflecting ToF system also includes a pair of planar electrode arrays, but these are circular in shape. Two sets of planar electrodes are disposed opposite one another, parallel to one another and axially offset from one another, the electrode structure generating a cylindrically symmetric, annular electric field surrounding a cylindrical, substantially field-free, central region, the electric field comprising an annular, axial focusing lens region and an annular mirror region surrounding the lens region.

These known multi-turn mass analysers have planar electrode arrays comprising multiple, flat electrodes mounted on a surface of an electrically insulating substrate in a close-packed configuration (e.g. the gap of electrodes is 2 mm in the multi-turn mass analyser disclosed in U.S. Pat. No. 7,919,748). Such electrode structures can be manufactured with relative ease because the electrodes can be formed on the substrate surface, in a desired pattern, by printing or by an alternative technique, such as cut-to-separate. However, in such a flat, packed electrode structure, the gaps between electrodes have to be narrow to avoid field distortion due to the effect of surface charge that accumulates on the substrate between electrodes. When ions undergoing oscillatory motion have energies of several keV, beam focusing (or similar measures designed to prevent beam divergence) necessitate provision of high voltage differences between neighbouring electrodes and, sometimes, such neighbouring electrodes are supplied with voltages of opposite polarity. According to examples in both WO 2012/116765 and U.S. Pat. No. 7,919,748, these voltage differences can exceed 10 kV, so there is potential for discharge and surface tracking. In U.S. Pat. No. 7,919,748 B2, Flory et al suggest depositing electrically resistive material in the gaps between electrodes. This might avoid the surface charge problem and might allow the gap between the adjacent electrodes to be increased to an extent. However, this approach requires that the resistivity of the electrically resistive material has an extremely high degree of homogeneity; otherwise, the electric field in the mass analysis space might be distorted. Moreover, when there is a high voltage difference between two electrodes, bridged by the resistive coating, current will pass through the resistive layer producing Joule heat. This causes the temperature to rise which, in turn, affects the stability of the high voltage supply and results in out-gassing in the mass analyzer, where ultra-high vacuum is usually necessary for long flight paths.

It is an object of this invention to provide a mass analyser which at least alleviates the afore-mentioned problems associated with known mass analysers.

SUMMARY OF THE INVENTION

According to the invention there is provided a mass analyser comprising a pair of electrode arrays, one electrode array of the pair being a mirror image of the other electrode array of the pair with respect to a centre plane mid-way between the electrode arrays, each array including a set of focusing electrodes and the electrode arrays being supplied, in use, with the same voltage pattern to create an electrostatic field in a space between the electrode arrays for causing ions to undergo periodic, oscillatory motion in said space whereby ions pass between electrodes of said sets of focusing electrodes and are repeatedly focused at the centre plane wherein at least one electrode of each said set of focusing electrodes has an electrode surface that is closer to the centre plane than the electrode surfaces of other electrodes of the same set.

With this arrangement, it has been found that a voltage difference between said one electrode and an immediately neighbouring electrode can be significantly reduced, thereby reducing a risk of electrical discharge between the electrodes, without having a significant adverse effect on the electrostatic field created in the space between the electrode arrays. Furthermore, the distance between the electrodes may also be increased, further reducing the risk of electrical discharge.

In preferred embodiments, said one electrode is positioned to face a region at the centre plane where electric field gradient has a maximum value, for example, where said one electrode and an immediately neighbouring electrode are supplied, in use, with voltages having opposite polarities, typically in an outer region of the space where ions are repeatedly reflected back towards the centre of the space as the ions undergo periodic oscillatory motion. In some preferred embodiments, said one and immediately neighbouring electrodes have electrode surfaces that are closer to said centre plane than the electrode surfaces of other electrodes of the same set.

Preferably, said one electrode of each said set of focusing electrodes is selected from the three outermost electrodes of the set.

It has been found that additional improvements to the form of the electrostatic field created in the space between the electrode arrays can be achieved by suitably profiling an electrode surface of said one, and optionally an immediately neighbouring electrode. The profiled surface(s) may have a trapezoidal or hyperbolic cross-section in a plane along the flight direction but orthogonal to the centre plane.

In some implementations of the invention, the electrodes of each said set are concentric ring electrodes.

It has been found that it is possible to tailor the geometry of said one electrode, and, optionally, an immediately neighbouring electrode to substantially replicate the electrostatic field created by an analyser having planar electrode arrays, where the electrodes are flat and lie in respective planes, and that this can be achieved even though the modified electrodes are supplied with reduced voltages.

Each said electrode array may be mounted on a base member made from electrically insulating material, such as a ceramic. Surface tracking between neighbouring electrodes may be a problem, especially if there is a large voltage difference between electrodes and the surface tracking distance along the insulator surface between the electrodes is not long enough. Therefore, in some embodiments of the present invention said one electrode and/or said base member are configured to increase surface tracking distance between said one electrode and a said immediately neighbouring electrode. To that end, said base member may be provided with a groove or recess between said one and immediately neighbouring electrodes, and/or said one electrode may be narrower at a lower part of the electrode, proximate the base member on which the electrode is mounted, than at an upper part of the electrode further away from the base member and/or said one electrode and, optionally, the immediately neighbouring electrodes may be mounted on the base member using an electrically insulating spacer(s). In yet another embodiment, the electrodes of each said electrode array are concentric ring electrodes, a ring electrode of an array including, and being mounted on the base member by, a plurality of electrically conductive fixing members, such as screws, pins, studs, or rivets, that are angularly offset with respect to electrically conductive fixing members that mount a neighbouring ring electrode on the base member. The base member may have grooves or slots configured to increase surface tracking distance between fixing members of neighbouring ring electrodes.

It will be appreciated that the foregoing measures used to increase surface tracking distance could be applied to mass analysers having alternatively configured electrode arrays; for example, planar electrode arrays wherein the focusing electrodes all have the same height relative to the centre plane. Therefore, according to another aspect of the invention there is provided a mass analyser comprising a pair of electrode arrays, one electrode array of the pair being a mirror image of the other electrode array of the pair with respect to a centre plane mid-way between the electrode arrays, each array including a set of focusing electrodes and the electrode arrays being supplied, in use, with the same voltage pattern to create an electrostatic field in a space between the electrode arrays for causing ions to undergo periodic, oscillatory motion in said space whereby ions pass between electrodes of said sets of focusing electrodes and are repeatedly focused at the centre plane wherein each said electrode array is mounted on a base member made from an electrically insulating material, at least one electrode of the array and or said base member being configured to increase surface tracking distance between said at least one and an immediately neighbouring electrode.

It will be understood that mass analysers according to the invention may have the form of electrostatic ion trap mass analysers or multi-turn ToF mass analysers and may have circular or rectangular configurations.

Embodiments of the invention are now described, by way of example only, with reference to the accompanying drawings of which:

FIGS. 1*a* and 1*b* are respectively plan and transverse sectional views of a known electrostatic ion trap mass analyser having a cylindrically symmetric configuration;

FIG. 2*a* is a transverse sectional view of the trapping part only of the analyser shown in FIG. 1*b*, with each electrode array mounted on a respective electrically insulating base member;

FIG. 2*b* is a transverse sectional view of the trapping part of an electrostatic ion trap mass analyser according to the present invention;

Figure 1A:
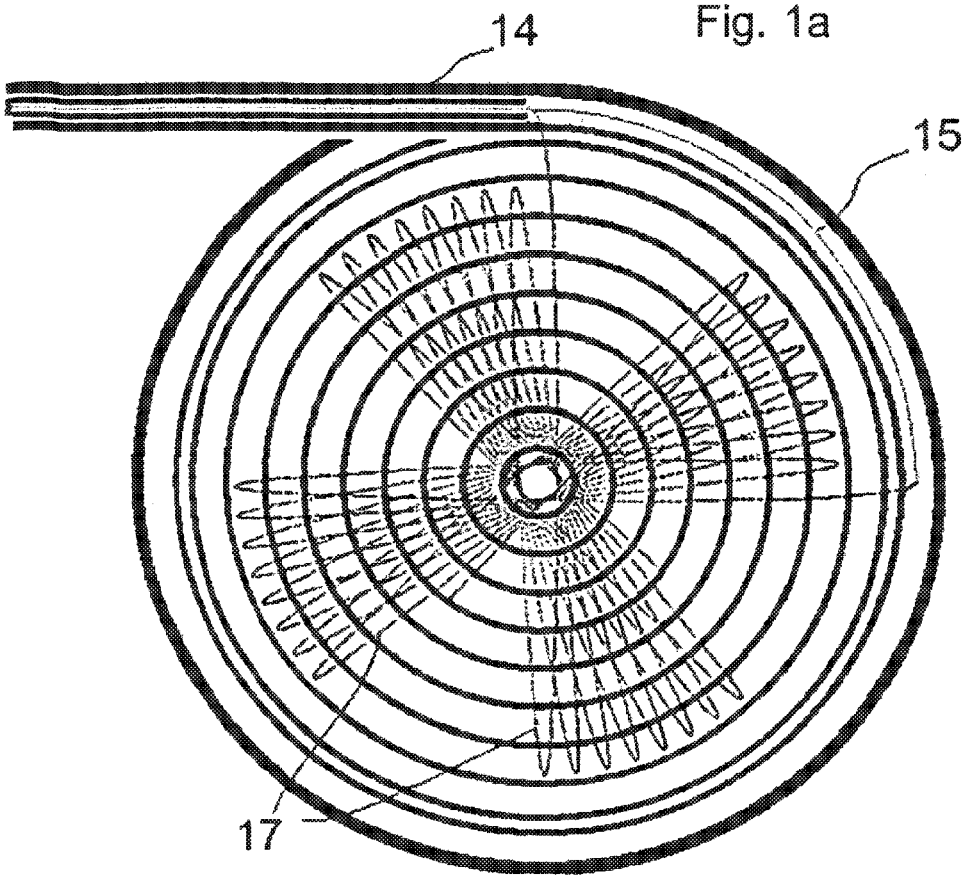
Figure 1B:
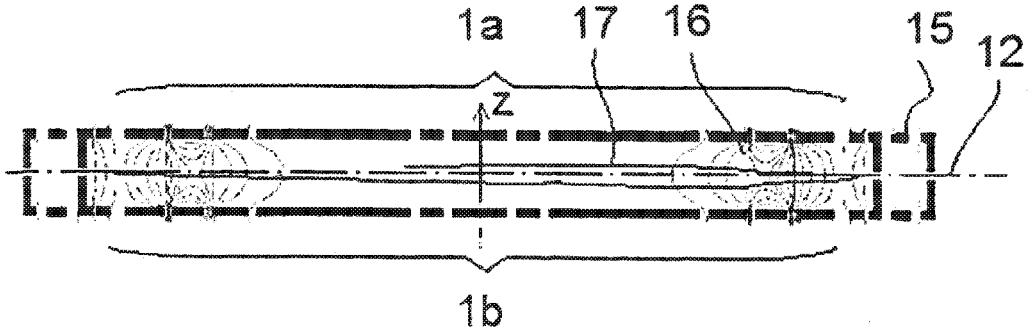

FIGS. 1*a* and 1*b* show an electrostatic ion trap mass analyser disclosed in WO 2012/116765 (Ding et al.). The electrostatic ion trap includes two arrays of concentric ring electrodes 1*a*, 1*b*, lying in mutually parallel planes. The two electrode arrays are arranged coaxially on the central axis (z) and are offset from one another to define a trapping space 16. One of the arrays is a mirror image of the other array with respect to the centre plane 12 and both arrays are supplied, in use, with the same voltage pattern. Ions produced by an ion source can be introduced into the trapping space 16 via a straight ion guide 14 and a curved ion guide 15. Ions pass along the straight ion guide 14 and then pass along the curved ion guide 15. While ions are travelling along the curved ion guide 15, a voltage pulse is applied to ion guide 15 causing ions to be injected radially inwards into the trapping space 16, where trapping electrostatic field is created by voltage supplied to the two arrays. Ions trapped in the trapping space 16 oscillate along an elliptical orbit 17 (in the x-y plane orthogonal to the z axis) with large aspect ratio and precess around the central axis z. Ion motion may have a component in the axial (z) direction and this is illustrated in the cross-sectional view in FIG. 1*b*. It is necessary to maintain an axial focusing force within the trapping space 16 so that ions will return to the centre plane 12 if there is an initial displacement from that plane or an initial velocity component in the axial direction; otherwise ion motion in the z direction will not be stable and ions will quickly collide with electrodes of one or other of the arrays. The focusing force in the z direction can be generated by provision of a voltage difference between the ring electrodes.

The same situation arises in the multi-turn type ToF system, where ions can either be injected from the circumference of the outer ring electrode, such as in the case of above-described electrostatic ion trap, or generated in a central region of the ring electrodes, or injected from the central region using a deflector/bender. Ions will undergo many oscillations through similar orbits and arrive at a detector also located in the central region of the device. To avoid beam dispersion in the axial direction, it is, again, necessary to create an electric field that acts as a focusing force in the z direction.

Figure 2A:
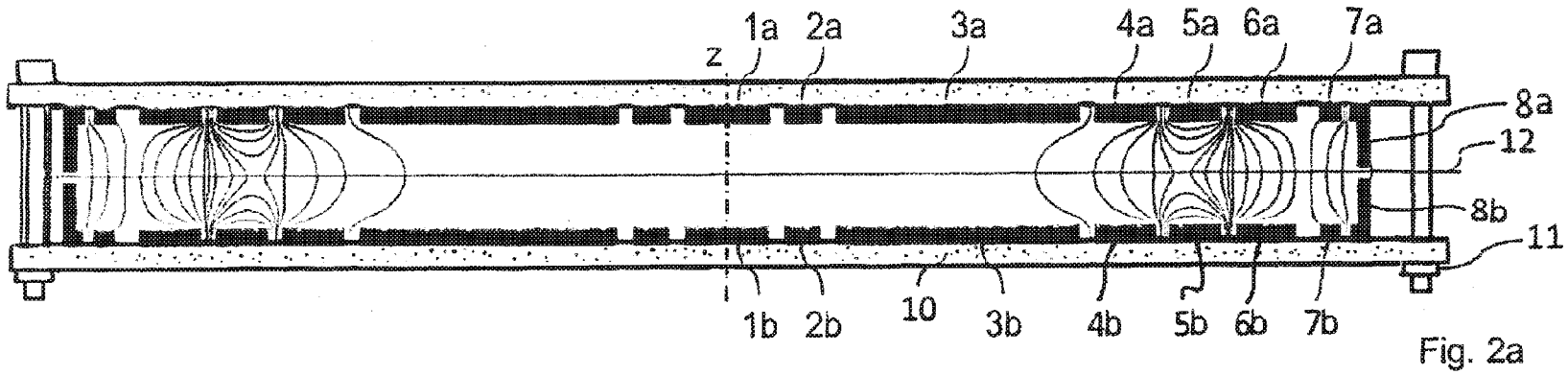

FIG. 2*a* is a transverse sectional view of the trapping part only of the electrostatic ion trap mass analyzer shown in FIG. 1*a*, but also shows supporting base members 10. Each electrode array has 8 concentric circular or ring electrodes. Of these, electrodes 1-7 constitute a set of focusing electrodes. Whereas electrodes 1*a* and *b*, 2*a* and *b* are responsible for time focusing to correct for an initial velocity spread in a tangential direction, electrodes 4*a* and *b*, 5*a* and *b*, 6*a* and *b* and 7*a* and *b* are responsible for spatial and time focusing to correct for a spread of initial position and initial velocity, respectively, in the axial z direction. On the other hand, the outermost electrodes 8*a* and 8*b* are gate/reflecting electrodes. Gate voltage is supplied to electrodes 8*a* and 8*b* allowing ions to enter the trapping space 16 between the electrode arrays, and this voltage is then switched to a higher potential to reflect ions undergoing oscillatory motion in the trapping space 16. Ions do not pass between electrodes 8 while ions are undergoing oscillatory motion in the trapping space and so electrodes 8 are not focusing electrodes. Each electrode array is attached to a respective base member 10 made from electrically insulating material before being assembled using screws 11. Focusing in the axial direction is mainly achieved by supplying negative voltage to the ring electrodes 5*a*, 5*b*, while keeping the immediately neighbouring ring electrodes 4*a*, 4*b*; 6*a*, 6*b* at a positive voltage or near ground potential. According to our calculation, ions having a radial flight energy as high as 4.6 kV, will require a focusing voltage on the flat ring electrodes 5*a*, 5*b* of about −11.4 kV and a voltage on the immediately neighbouring electrodes 6*a*, 6*b* of about 4.6 kV; that is, a voltage difference of 16 kV. With such a high voltage difference and, typically, a gap of only 2 mm between the electrodes electrical discharge might occur.

Figure 2B:
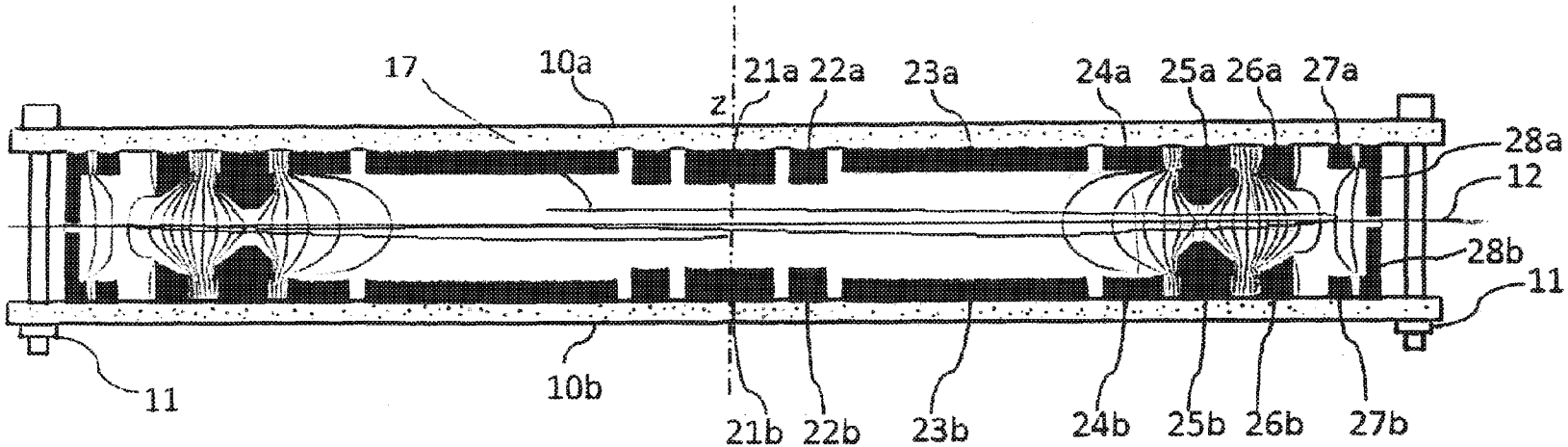

FIG. 2*b* is substantially the same as FIG. 2*a*, but illustrates how the electrode structure has been modified, in accordance with the invention, with a view to at least alleviating this problem.

FIGS. 2*a* and 2*b* both show equipotentials created by supplying voltage to the electrodes of the respective electrode structures. It has been found, by simulation, that it is possible to supply significantly reduced voltage to the modified electrodes (25*a*; 25*b*), and thereby reduce the voltage difference between those electrodes and the neighbouring electrodes in each array, without a significant reduction of field strength in the space between the electrode arrays. In this particular example, the geometry of electrodes (25*a*, 26*a*; 25*b*, 26*b*), including their surface profiles, was tailored to mimic the shape of the −6.4 keV equipotential line produced by the electrode structure of FIG. 2*a*. A comparison of FIGS. 2*a* and 2*b* shows that the shapes of the equipotential lines produced by the two electrode structures are substantially the same.

Referring again to FIG. 2*b*, the ring electrodes 21*a*-27*a*; 21*b*-27*b* of each electrode array constitute a set of focusing electrodes. Each set of focusing electrodes and the outermost gate electrode 28*a*; 28*b* are mounted on a respective base member 10*a*; 10*b* made from electrically insulating material, such as a ceramic. The two electrode arrays are assembled coaxially, on the central axis z, and are axially offset from each other defining a trapping space between the electrode arrays. One electrode array is a mirror image of the other electrode array, with respect to the centre plane 12, mid-way between the two arrays, and both arrays are supplied in use with the same voltage pattern, whereby corresponding electrodes of the two arrays i.e. 21*a*, 21*b*; 22*a*, 22*b* etc are supplied with the same voltage.

In contrast to the electrodes shown in FIG. 2*a*, the heights of selected electrodes shown in FIG. 2*b* have been increased in the axial direction so that their electrode surfaces are closer to the centre plane 12 and, in this embodiment, their surface profiles have also been changed. More specifically, electrodes 25*a*, 25*b* have electrode surfaces that are closer to the centre plane 12 than the electrode surfaces of the immediately neighbouring electrodes 24*a*, 24*b*; 26*a*, 26*b*, and they no longer have a flat surface profile.

Similar changes are also made to electrodes 26*a*, 26*b*, and the gap between each pair of neighbouring electrodes 25*a*,

26*a*; 25*b*, 26*b* at the respective base member is also increased. As a result of these changes, voltages that need to be supplied to electrodes 25*a*, 26*a*; 25*b*, 26*b* to generate the same or very similar field near the centre plane 12 as that generated by the electrode structure of FIG. 2*a* are reduced to −6.4 kV and 4 kV respectively so that the voltage difference is reduced to 10.4 kV.

The closer electrodes 25*a* and 25*b* are to the center plane, the greater will be the reduction of voltage supplied to those electrodes. Preferably, though, the distance of electrode 25*a* (and 25*b*) from the center plane is no less than the thickness of the ion beam (typically 2 mm), so that the gap between electrodes 25*a* and 25*b* is no less than twice the beam thickness. In this example, electrodes 25*a* and 25*b* have a trapezoidal cross-section in a plane along the flight direction, but orthogonal to the centre plane, although other surface profiles having hyperbolic, triangular or stepwise cross-sections could alternatively be used.

The minimum tolerable gap between the electrodes supplied with voltages having opposite polarities is 3 mm. A gap of 3 mm in ultrahigh vacuum can normally withstand a voltage difference in excess of 12 kV, although good surface smoothness is required. As will be described in greater detail hereinafter, surface tracking distance between electrodes may also be increased and this should be larger than the arcing distance between the electrodes.

Whereas one or more electrodes may have electrode surfaces that are closer to the centre plane, it might still be desirable that electrode surfaces of other electrodes are more distant thereby providing a wider trapping space, relatively free from obstacles with which ions following wider trajectories might otherwise collide.

At the same time, a more distant field forming electrode requires simpler geometry and less accuracy in forming its surface profile; that is, because these more distant electrodes are further away from the ion trajectories, inaccuracies in their geometries will have less influence on the electrostatic field to which ions are exposed. Therefore, the electrode geometries will be a result of optimization, a compromise of achievable field strength and field accuracy.

An electrode that is selected to have an electrode surface closer to the centre plane is preferably an electrode that is located in a region where a relatively high radial field gradient is needed. Often, this will be an electrode that is supplied with voltage of opposite polarity to voltages supplied to its immediately neighboring electrodes, such as in the case of electrodes 25*a*, 25*b* in FIG. 2*b*. As these electrodes are relatively large diameter electrodes, an electrode arranged to have an electrode surface closer to the centre plane will usually, but not necessarily, be located in an outer region (in the radial direction) of each electrode array.

It is preferred to select a focusing electrode having a relatively large radius to be closer to the centre plane than a neighbouring ring electrode having a smaller radius. This means that at least one ring electrode near the gate/reflector ring electrode is closer to the center plane. A larger diameter electrode selected to be closer to the centre plane serves to screen an inner region of the trapping space from a varying electric field caused by the closing action of the gate electrode. Therefore, ions reaching an inner region of the trapping space will not be subjected to a mass-dependent acceleration due to a rising potential at the gate electrode.

As already explained electrodes of each electrode array are mounted on an electrically insulating base member 10*a*; 10*b*. Surface tracking may occur at the electrically insulating surface of the base member if two neighbouring electrodes are supplied with voltage having a large voltage difference, even in a high vacuum environment. To increase the tracking distance on the insulating surface between neighbouring electrodes, each electrode 25*a*; 25*b* is designed to be narrower at a lower part of the electrode, proximate the base member on which it is mounted, than at an upper part of the electrode further away from the base member. In order to further increase the tracking distance between nearby electrodes at the surface of the base member, the following configurations are proposed in combination with the above electrode design.

Figure 3:
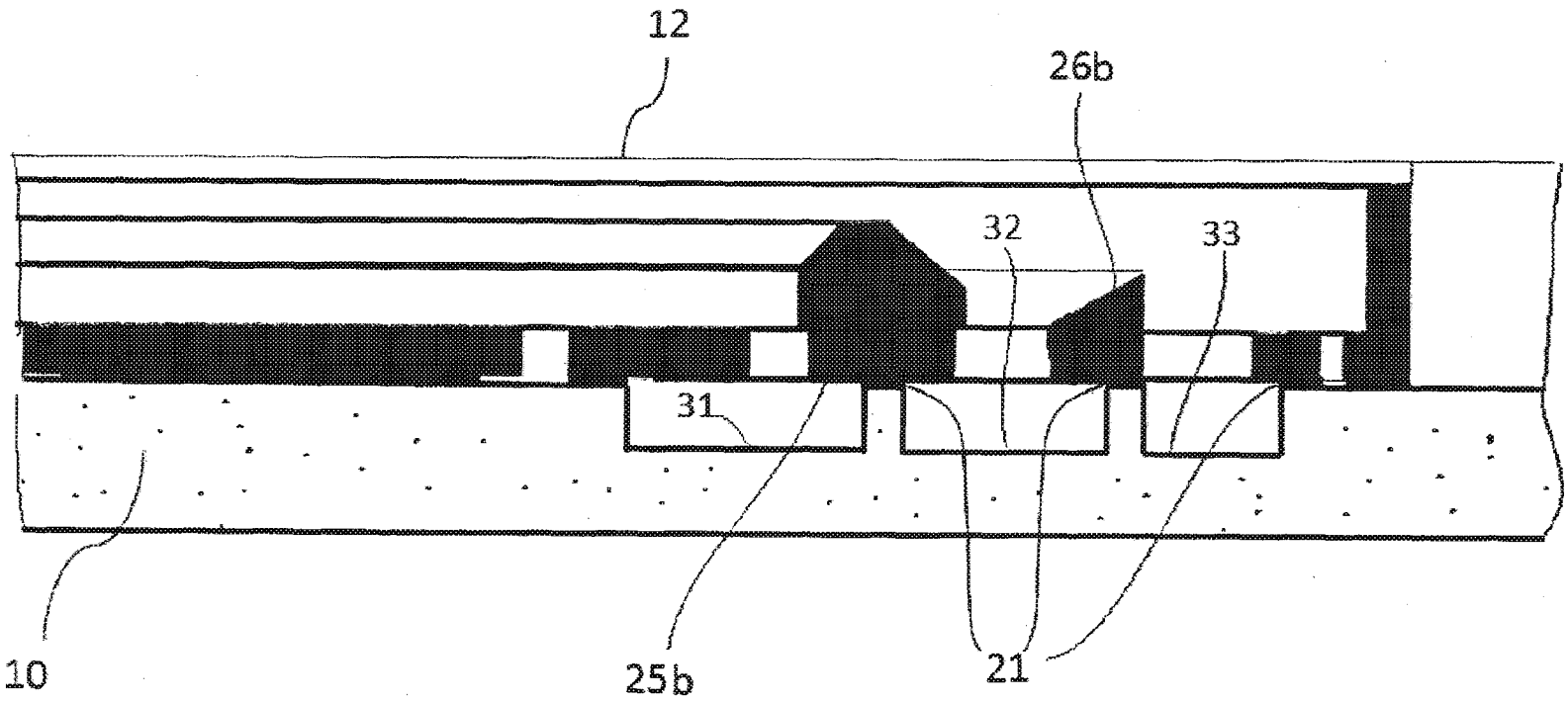
FIGS. 3 and 4 are transverse sectional views of an outer part of one of the electrode arrays shown in FIG. 2*b* and further illustrate alternative arrangements for increasing surface tracking distance.

Referring to FIG. 3, ring electrodes 25*b*, 26*b* etc. are attached to the base member 10, made from electrically insulating material such as a ceramic, a macor or glass, using one of the bonding methods below at the bonding points 21. The methods can be:

1) Brazing the metal electrode to the ceramic which has been previously metalized on the bonding surface. Metallization of ceramic may be achieved by using any suitable thick film technology, such as screen printing and annealing or using physical or chemical vapor deposition.
2) Soldering the metal electrode to the ceramic which has previously been metalized on the bonding surface.
3) Using epoxy or other vacuum compatible adhesives.

At locations below the electrodes, where high voltage difference occurs, the ceramic base is cut away with deep grooves or recesses so the surface distance between the bonding points 21 is increased. This effectively increases the surface tracking distance between the two electrodes.

Figure 4:
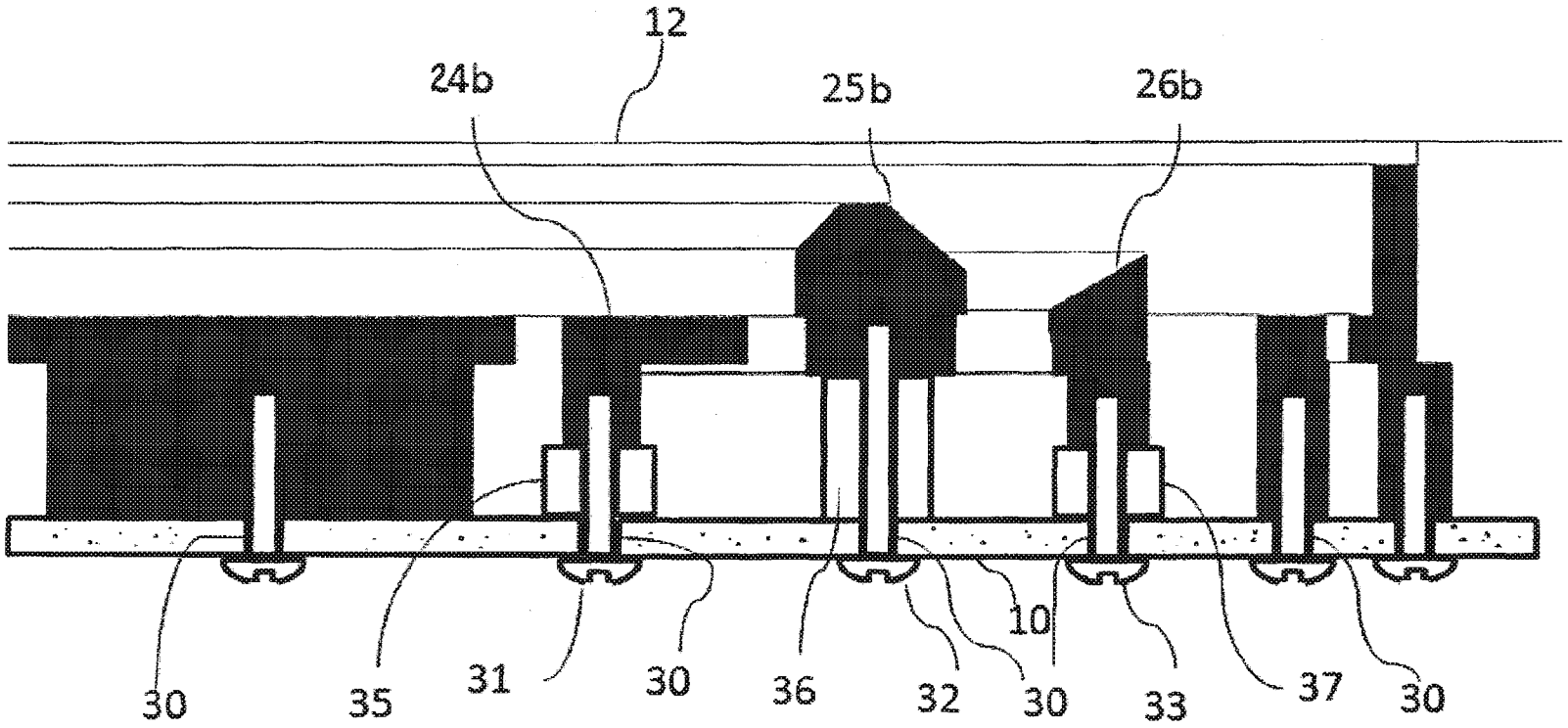

An alternative way to increase the surface tracking distance without cutting into the insulating base member is shown in the FIG. 4. With this approach the electrodes 24*b*, 25*b* and 26*b* are attached to the insulating base member 10 using screws 31, 32, 33. Electrically insulating spacers 35, 36, 37 are provided between the base member 10 and the electrodes 24*b*, 25*b*, and 26*b* to increase the surface tracking distances.

The screws 31, 32, 33 can be made of metal or are preferably made of ceramic or other high tension plastic materials. The screws are only used for fastening purposes so they may be replaced with other kinds of fixing members, such as studs, pins or rivets as long as they hold the base member and electrodes together.

Figure 5:
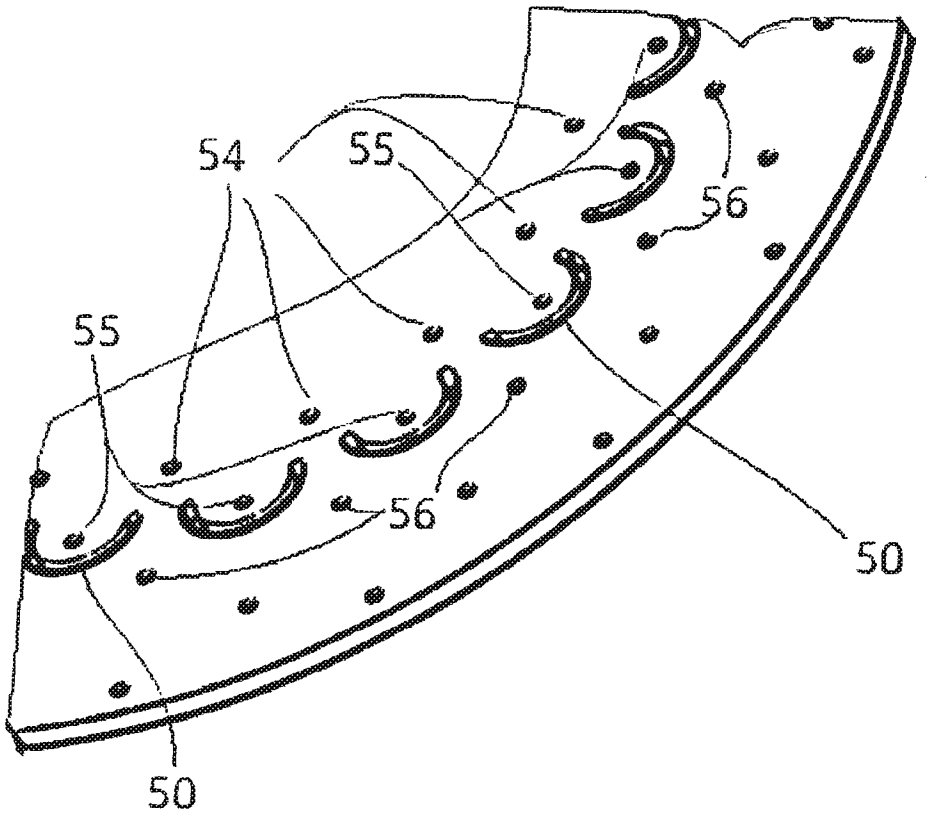
FIG. 5 is a perspective view of part of the underside of an electrically insulating base member for supporting concentric ring electrodes using screws or alternative fixing members.

In the case of electrically conductive fixing members, surface tracking may occur between the nearest fixing members of neighbouring electrodes, along an underside surface of the base member. There may need to be as many as 8 or more of these fixing members (e.g. screws) to hold each electrode firmly; however the angular distribution of the fixing members of the ring electrodes should be interleaved so as to achieve the maximum surface tracking distances between fixing members. As shown in FIG. 5, for example, screws 55 are used to fix one electrode (for example 5*b*) to the base member, whereas screws 56 are used to fix the neighbouring electrode (for example 6*b*). The angular distribution of the screws 55 is shifted by a certain angle relative to the angular distribution of screws 56, so that the two sets of screws are angularly offset with respect to each other so as to increase the surface tracking distance between adjacent screws. Likewise for other screw sets (e.g. 54) used to fix the other electrodes.

If metal screws, pins, studs, or rivets are used there is an additional way to avoid shorting between these components. As shown in FIG. 5, multiple grooves 50 are cut between screw holes 55 and 56, so electric tracking cannot run directly from one screw to another and so the effective surface tracking distance is longer than the direct distance between the screws.

Figure 6:
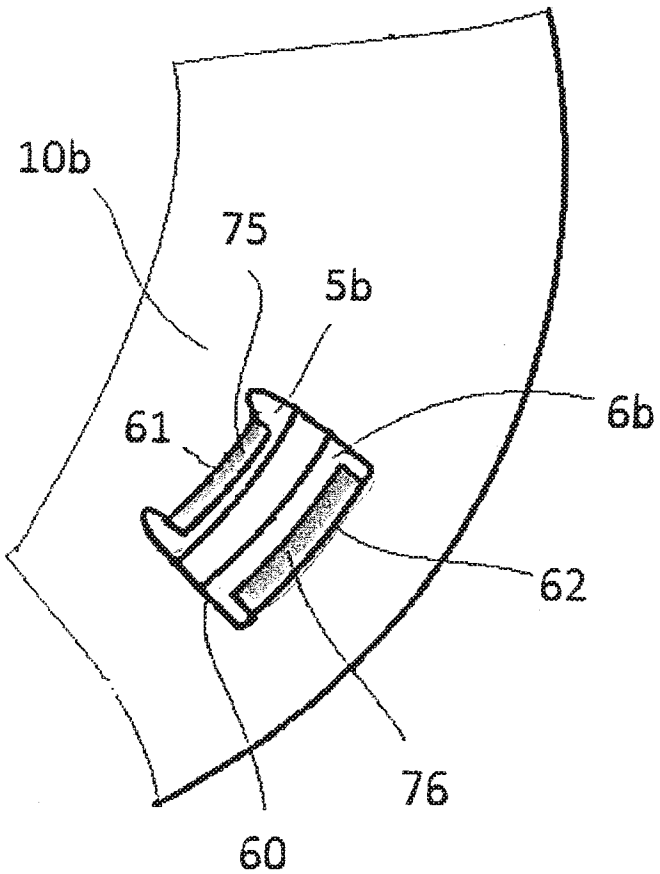
FIG. 6 is a perspective view of the underside of part of an electrically insulating base member showing respective fixing members of two immediately neighbouring ring electrodes mounted on the base member.

With modern CNC machining, it is possible to produce ring electrodes having fixing members, such as legs, fingers or pads that project from their undersides. FIG. 6 shows part of the underside of a ceramic base plate 10 having a number of cut-out openings 60, of which only one is shown in FIG. 6. Each ring electrode 5*b*; 6*b* is mounted on the topside (not shown) of base plate 10*b* and has several connection pads which project from the underside of the electrode and are inserted into respective openings 60 of the base plate 10*b*.Only one such connection pad 75; 76 of each ring electrode 5*b*; 6*b* is shown in FIG. 6. Pads 75; 76 may be soldered to the ceramic base plate 10*b* along two edges of opening 60 having edge surfaces 61, 62 that have been metalized beforehand. A gap between the connection pads 75; 76 serves to increase surface tracking distance between the electrodes because electric tracking cannot run directly between the electrodes.

Although the electrode structure according to this invention was described in embodiment of a planar electrostatic ion trap, it will be understood that mass analyzers according to the invention may also have the form of multi-turn ToF mass analyzer or, an analyzer that can be switched between the mode of planar electrostatic ion trap where image charge is detected and the mode of multi-turn ToF using a particle detector such as a MCP. The later configuration can be facilitated by using afore mentioned external ion injector and adding one MCP detector outside the circumference of the analyzer and keep the image charge detection circuitry coupled to some of the focusing electrodes. The ToF measurement may be activated by switching down the voltage on gate/reflecting electrode after several oscillatory flight of ions in the analyzer, so ions can be released from the trapping region to the detector and time of flight signal can be recorded. The configuration of the analyzer can either be in rectangular shape with straight strip electrodes or in circular shape with ring electrodes described in above embodiment.

The invention claimed is:

1. A mass analyser comprising a pair of electrode arrays, one electrode array of the pair being a mirror image of the other electrode array of the pair with respect to a centre plane mid-way between the electrode arrays, each array including a set of focusing electrodes and the electrode arrays being supplied, in use, with the same voltage pattern to create an electrostatic field in a space between the electrode arrays for causing ions to undergo periodic, oscillatory motion in said space whereby ions pass between electrodes of said sets of focusing electrodes and are repeatedly focused at the centre plane, wherein at least one electrode of each said set of focusing electrodes has an electrode surface that is closer to the centre plane than the electrode surfaces of other electrodes of the same set.

2. A mass analyser as claimed in claim 1 wherein said one electrode is positioned to face a region at the centre plane where electric field gradient has a maximum value.

3. A mass analyser as claimed in claim 1 wherein said one electrode and an immediately neighbouring electrode of the same set are supplied, in use, with voltage having opposite polarities.

4. A mass analyser as claimed in claim 3 wherein said one and immediately neighbouring electrodes have electrode surfaces that are closer to said centre plane than the electrode surfaces of other electrodes of the same set.

5. A mass analyser as claimed in claim 1 wherein said one electrode has a profiled electrode surface facing the centre plane.

6. A mass analyser as claimed in claim 4 wherein said one and immediately neighbouring electrodes both have profiled electrode surfaces.

7. A mass analyser as claimed in claim 5 wherein said profiled electrode surfaces have trapezoidal or hyperbolic cross-sections in a plane orthogonal to the centre plane and along a flight direction of ions.

8. A mass analyser as claimed in claim 1 wherein said one electrode of each said set of focusing electrodes is selected from the three outermost electrodes of the set.

9. A mass analyser as claimed in claim 1 wherein each said electrode array is mounted on a base member made from an electrically insulating material, said one electrode and or said base member being configured to increase surface tracking distance between said one and a said immediately neighbouring electrode.

10. A mass analyser as claimed in claim 9 wherein said base member is provided with a groove or recess between said one and said immediately neighbouring electrodes to increase surface tracking distance between said one and said immediately neighbouring electrodes.

11. A mass analyser as claimed in claim 9 wherein said one electrode is narrower at a lower part of the electrode, proximate the base member on which the electrode is mounted than at an upper part of the electrode further away from the base member to increase surface tracking distance between said one and a said immediately neighbouring electrode.

12. A mass analyser as claimed in claim 9 wherein said one electrode is mounted on the base member using an electrically insulating spacer to increase surface tracking distance between said one electrode and a said immediately neighbouring electrode.

13. A mass analyser as claimed in claim 12 wherein a said immediately neighbouring electrode is also mounted on said base member using an electrically insulating spacer.

14. A mass analyser as claimed in claim 9 wherein the electrodes of each electrode array are mounted on the base member by fixing members.

15. A mass analyser as claimed in claim 1 wherein the electrodes of each said set are concentric ring electrodes.

16. A mass analyser as claimed in claim 9 wherein the electrodes of each said electrode array are concentric ring electrodes, a ring electrode of an array including, and being mounted on the base member by, a plurality of electrically conductive fixing members that are angularly offset with respect to electrically conductive fixing members that mount a neighbouring ring electrode on the base member.

17. A mass analyser as claimed in claim 16 wherein the base member has grooves or slots configured to increase surface tracking distance between fixing members of neighbouring ring electrodes.

18. A mass analyser as claimed in claim 9 wherein the electrodes of each said array are mounted on the base member by brazing, soldering or adhesive bonding.

19. A mass analyser as claimed in claim 9 wherein electrodes of each electrode array are mounted on a said base member formed with a plurality of openings, at least two electrodes of the array are formed with a plurality of fixing members, a fixing member of one electrode and a fixing member of an immediately neighbouring electrode both being mounted in a respective opening in the base member with a gap between the fixing members to increase surface tracking distance between the one and immediately neighbouring electrodes.

20. A mass analyser as claimed in claim 19 wherein said fixing members are mounted on metalised edge surfaces of the openings.

21. A mass analyser comprising a pair of electrode arrays, one electrode array of the pair being a mirror image of the other electrode array of the pair with respect to a centre plane mid-way between the electrode arrays, each array including a set of focusing electrodes and the electrode arrays being supplied, in use, with the same voltage pattern to create an electrostatic field in a space between the electrode arrays for causing ions to undergo periodic, oscillatory motion in said space whereby ions pass between electrodes of said sets of focusing electrodes and are repeatedly focused at the centre plane, wherein each said electrode array is mounted on a base member made from an electrically insulating material at least one electrode of the array and or said base member being configured to increase surface tracking distance between said at least one and an immediately neighbouring electrode.

22. A mass analyser as claimed in claim 21 wherein said base member is provided with a groove or recess between said one and said immediately neighbouring electrodes to increase surface tracking distance between said one and said immediately neighbouring electrodes.

23. A mass analyser as claimed in claim 21 wherein said one electrode is narrower at a lower part of the electrode, proximate the base member on which the electrode is mounted, than at an upper part of the electrode further away from the base member to increase surface tracking distance between said one and a said immediately neighbouring electrode.

24. A mass analyser as claimed in claim 21 wherein said one electrode is mounted on the base member using an electrically insulating spacer to increase surface tracking distance between said one electrode and a said immediately neighbouring electrode.

25. A mass analyser as claimed in claim 24 wherein a said immediately neighbouring electrode is also mounted on said base member using an electrically insulating spacer.

26. A mass analyser as claimed in claim 21 wherein the electrodes of each electrode array are mounted on the base member by fixing members.

27. A mass analyser as claimed in claim 21 wherein the electrodes of each said set are concentric ring electrodes.

28. A mass analyser as claimed in claim 21 wherein the electrodes of each said electrode array are concentric ring electrodes, a ring electrode of an array including, and being mounted on the base member by, a plurality of electrically conductive fixing members that are angularly offset with respect to electrically conductive fixing members that mount a neighbouring ring electrode on the base member.

29. A mass analyser as claimed in claim 28 wherein the base member has grooves or slots configured to increase surface tracking distance between fixing members of neighbouring ring electrodes.

30. A mass analyser as claimed in claim 21 wherein electrodes of each electrode array are mounted on a said base member formed with a plurality of openings, at least two electrodes of the array are formed with a plurality of fixing members, a fixing member of one electrode and a fixing member of an immediately neighbouring electrode both being mounted in a respective opening in the base member with a gap between the fixing members to increase surface tracking distance between the one and immediately neighbouring electrodes.

31. A mass analyser as claimed in claim 30 wherein said fixing members are mounted on metalised edge surfaces of the openings.

32. A mass analyser as claimed in claim 14 wherein said fixing members are screws, pins, studs or rivets.

33. A mass analyser as claimed in claim 1 being an electrostatic ion trap mass analyser.

34. A mass analyser as claimed in claim 1 being a multi-turn ToF mass analyser.

35. A mass analyser as claimed in claim 1 being an analyzer switchable between a electrostatic ion trap analyser and a multi-turn ToF mass analyser.

* * * * *